US012055366B2

(12) United States Patent
Poplawski et al.

(10) Patent No.: US 12,055,366 B2
(45) Date of Patent: Aug. 6, 2024

(54) RENEWABLE ENERGY POWERED WEAPON SIGHT

(71) Applicant: MEPROLIGHT (1990) LTD., Or-Akiva (IL)

(72) Inventors: Jorge Poplawski, Haifa (IL); Doron Segal, Netanya (IL)

(73) Assignee: MEPROLIGHT (1990) LTD., Or-Akiva (IL)

( * ) Notice: Subject to any disclaimer, the term of this patent is extended or adjusted under 35 U.S.C. 154(b) by 0 days.

(21) Appl. No.: 17/744,785

(22) Filed: May 16, 2022

(65) Prior Publication Data

US 2023/0032342 A1 Feb. 2, 2023

(30) Foreign Application Priority Data

May 27, 2021 (IL) ..... 283500

(51) Int. Cl.
*F41G 1/34* (2006.01)

(52) U.S. Cl.
CPC ..... *F41G 1/345* (2013.01)

(58) Field of Classification Search
CPC ..... F41G 1/345
See application file for complete search history.

(56) References Cited

U.S. PATENT DOCUMENTS 9,982,965 B2 5/2018 Sun
2002/0191401 A1* 12/2002 He ..... H05B 45/12 362/183
2020/0271419 A1 8/2020 Grace
2021/0010784 A1 1/2021 Sheets, Jr.
2021/0028419 A1 1/2021 Sun et al.

FOREIGN PATENT DOCUMENTS

WO WO-2017211074 A1 * 12/2017

* cited by examiner

*Primary Examiner* — Reginald S Tillman, Jr.
(74) *Attorney, Agent, or Firm* — SOROKER AGMON NORDMAN RIBA

(57) ABSTRACT

A weapon sight, including a photon energy harvesting device configured to accept photon energy from light surrounding the weapon sight, an electrical energy storing element configured to store electrical energy from the photon energy harvesting device in the form of an electric field, a load configured to be powered by the electrical energy storing element, a voltage regulator configured to limit the release rate of current from the electrical energy storing element to power the load.

14 Claims, 4 Drawing Sheets

RENEWABLE ENERGY POWERED WEAPON SIGHT

FIELD OF THE DISCLOSURE

The present disclosure relates to a weapon sight that is powered by ambient light and more specifically wherein the ambient light is converted to electrical energy and stored for later use.

BACKGROUND OF THE DISCLOSURE

Weapon sights are typically used to aid a user to accurately aim a firearm toward a target. Some weapon sights require electrical power to function, for example to display a reticle, a LED dot, produce an infra-red or visible laser beam or perform other functions. In the dark the sight might be illuminated for the user.

Generally the sight is powered by a battery that is replaceable or rechargeable. Before use of the sight, the user needs to replace the battery or recharge the battery. Continuously replacing batteries, requires that the user keep a stock of batteries with the sight. Likewise recharging batteries requires frequently monitoring the charge status of the batteries and plugging a charger into an electrical power outlet to charge the battery for a significant amount of time if the battery charge has depleted.

SUMMARY OF THE DISCLOSURE

An aspect of an embodiment of the disclosure, relates to a system and method for powering a weapon sight. The system includes a supercapacitor for quickly storing electrical charge produced from ambient light, for example with solar cells. The supercapacitor is charged while using the weapon sight under favorable light conditions and capable of powering the weapon sight when the surrounding environment is dark. A regulator controls the output voltage and release of current from the supercapacitor to power the sight's electric load. During daylight operations, the weapon sight is powered directly from the solar cells or indirectly from the supercapacitor.

In an embodiment of the disclosure, the system may also include a backup rechargeable battery, which is electrically charged indirectly by the supercapacitor. The supercapacitor serves as a fast charge storage, whereas the battery serves as a slow charge storage that provides charge if the supercapacitor power level is below a threshold value.

There is thus provided according to an embodiment of the disclosure, a weapon sight, comprising:

- A photon energy harvesting device configured to accept photon energy from light surrounding the weapon sight;
- An electrical energy storing element configured to store electrical energy from the photon energy harvesting device in the form of an electric field;
- A load configured to be powered by the electrical energy storing element;
- A voltage regulator configured to limit the release rate of current from the electrical energy storing element to power the load.

In an embodiment of the disclosure, the weapon sight is powered only by the electrical energy storing element. Optionally, the electrical energy storing element is a supercapacitor. In an embodiment of the disclosure, the photon energy collecting device comprises solar cells. Optionally, the load includes at least a single dot LED light. In an embodiment of the disclosure, the voltage regulator is configured to increase or decrease the current provided to the load responsive to the lighting conditions surrounding the weapon sight. Optionally, the illumination brightness of the sight is stronger when the light surrounding the weapon sight is stronger. In an embodiment of the disclosure, the current provided to the load is user selectable.

Optionally, the weapon sight further comprises a backup power supply that receives electrical energy from the electrical energy storing element and stores the electrical energy in chemical form. In an embodiment of the disclosure, a percentage of the power provided from the electrical energy storing element to the load is provided to the backup power supply to store. Optionally, the backup power supply is charged only after the electrical storage element is charged to a preselected level. In an embodiment of the disclosure, the load is powered from the backup power supply only if the power level from the electrical storage element goes below a threshold value.

There is further provided according to an embodiment of the disclosure, a method of powering a weapon sight, comprising:

Accepting photon energy from light surrounding the weapon sight with a photon energy harvesting device:

Storing electrical energy from the photon energy harvesting device to an electrical energy storing element that is configured to store electrical energy in the form of an electric field;

Powering a load with electrical power from the electrical energy storing element:

Limiting the release rate of current from the electrical energy storing element with a voltage regulator.

BRIEF DESCRIPTION OF THE DRAWINGS

The present disclosure will be understood and better appreciated from the following detailed description taken in conjunction with the drawings. Identical structures, elements or parts, which appear in more than one figure, are generally labeled with the same or similar number in all the figures in which they appear, wherein.

DETAILED DESCRIPTION

Figure 1:
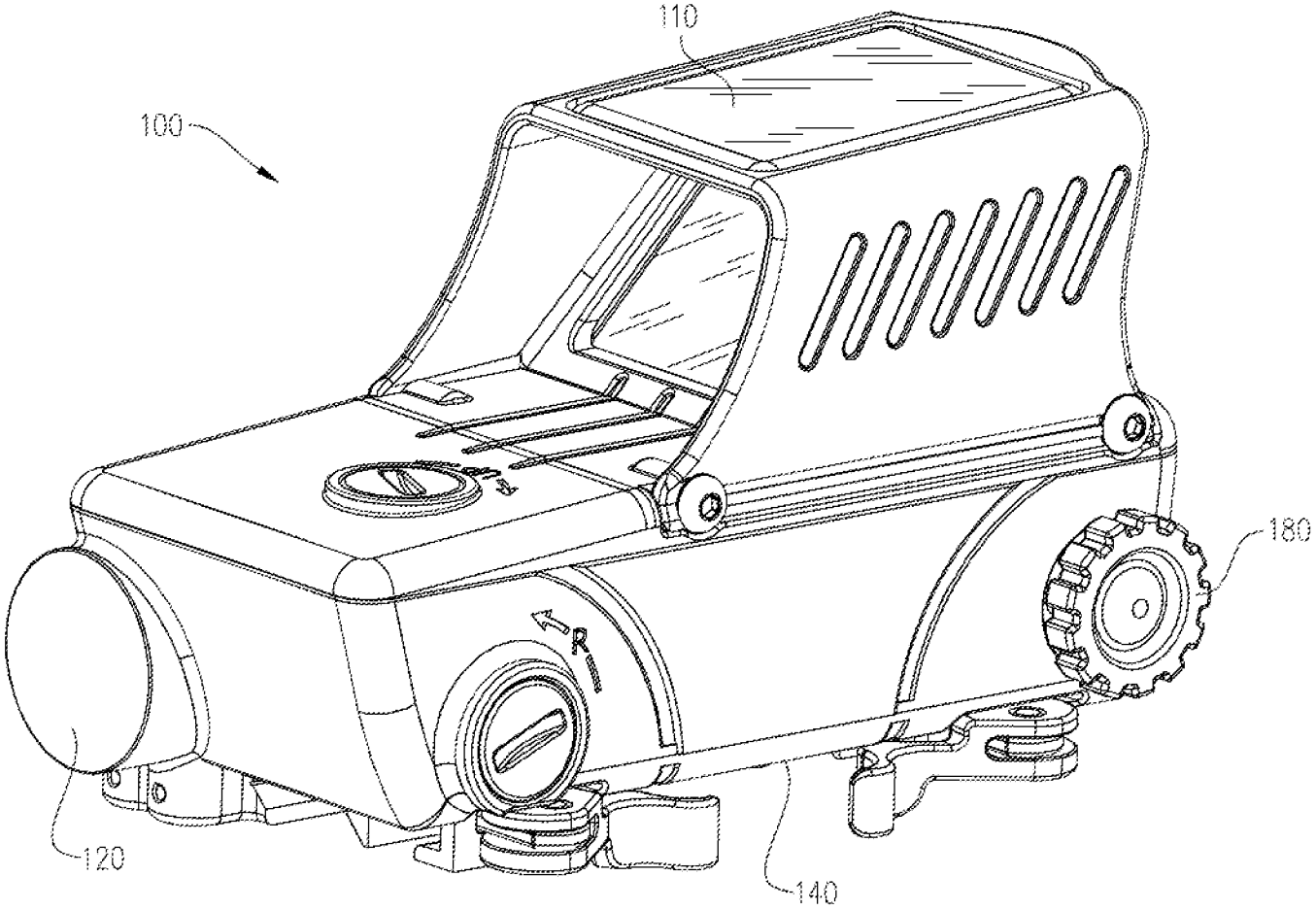
FIG. 1 is a schematic illustration of a weapon sight, according to an embodiment of the disclosure.

FIG. 1 is a schematic illustration of a weapon sight 100, according to an embodiment of the disclosure. The weapon sight 100 includes a photon energy harvesting device 110, for example solar cells for collecting photon energy from ambient light (e.g. any light surrounding the sight). The weapon sight further includes a fast electrical energy storing element 120, for example a supercapacitor for storing electrical energy harvested from photons of the ambient light. Optionally, while the weapon sight 100 is used during the day or in a lighted room, the photon energy harvesting device 110 generates electrical energy and charges the fast electrical energy storing element 120 to provide electrical power for immediate use and for later use, for example at night or in the dark. Optionally, use of the weapon sight 100 for a minimum amount of time under sunlight (e.g. a few minutes) is sufficient to power the weapon sight for a few hours, since the electrical energy storing element 120 is able to quickly store electrical charge and the consumption of the charge is regulated by control circuits as explained below. As a result weapon sight 100 serves as a passive device that can function independently during normal use, without needing to be connected to a power grid to be charged or to replace batteries.

Figure 2:
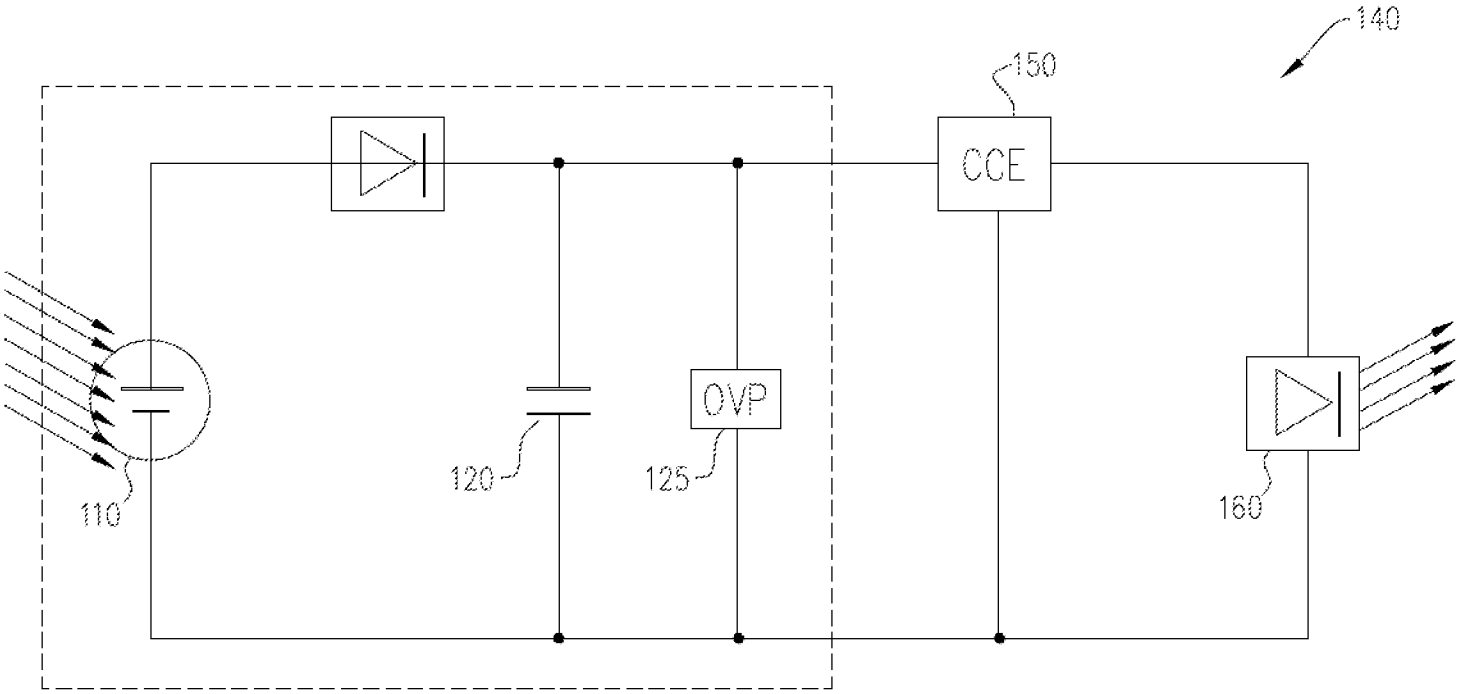
FIG. 2 is a schematic illustration of an electronic circuit, according to an embodiment of the disclosure.

In an embodiment of the disclosure, weapon sight 100 includes an electronic circuit 140 and an activation switch 130 to turn on or off power consumption in sight 100 while the energy harvesting and storage is still enabled. FIG. 2 is a schematic illustration of an electronic circuit 140, according to an embodiment of the disclosure. In an embodiment of the disclosure, circuit 140 includes a photon energy harvesting device 110 (e.g. solar cells) and a storing element 120 (e.g. a supercapacitor) to collect electrical charge while light is available. Optionally, while there is light, photon energy harvesting device 110 charges storing element 120. In an embodiment of the disclosure, storing element 120 provides electrical power (e.g. a constant current) via a voltage regulator 150, which includes a logic current selector, to a load 160 (e.g. a LED light).

In some embodiments of the disclosure, electronic circuit 140 may further include an over voltage protector (OVP) 125 to regulate the voltage and current stored and retrieved from the storing element 120.

Optionally, the photon energy harvesting device 110 is a supercapacitor such as DGH156Q2R7 manufactured by Illinois Capacitor Inc. from Des Planes, Illinois. Likewise supercapacitors are manufactured by Kemet (a Yageo company). An exemplary supercapacitor may have an electrical charge storage capacity of 50-500 Farad or more, which may be enough to power weapon sight 100 for at least a few days.

In an embodiment of the disclosure, a supercapacitor saves the potential electric energy in the form of an electric field between plates of the supercapacitor, in contrast to a rechargeable battery where the potential electric energy is stored in chemical form thus taking much longer to charge (e.g. a supercapacitor typically charges 10,000 times faster). Likewise the supercapacitor is lighter than a battery and has an almost infinite life cycle expectancy. Typically a battery may hold a charge for a more extended period. Thus the super-capacitor may be used to power a weapon sight 100 that will be charged quickly for a short period, e.g. during the day (either while being used or only charging), and then consume the stored charge during use for an entire night. In an embodiment of the disclosure, the sight 100 is powered only directly by the photon energy harvesting device 110 and/or indirectly by the electrical energy storing element 120 and not by a battery.

Figure 3:
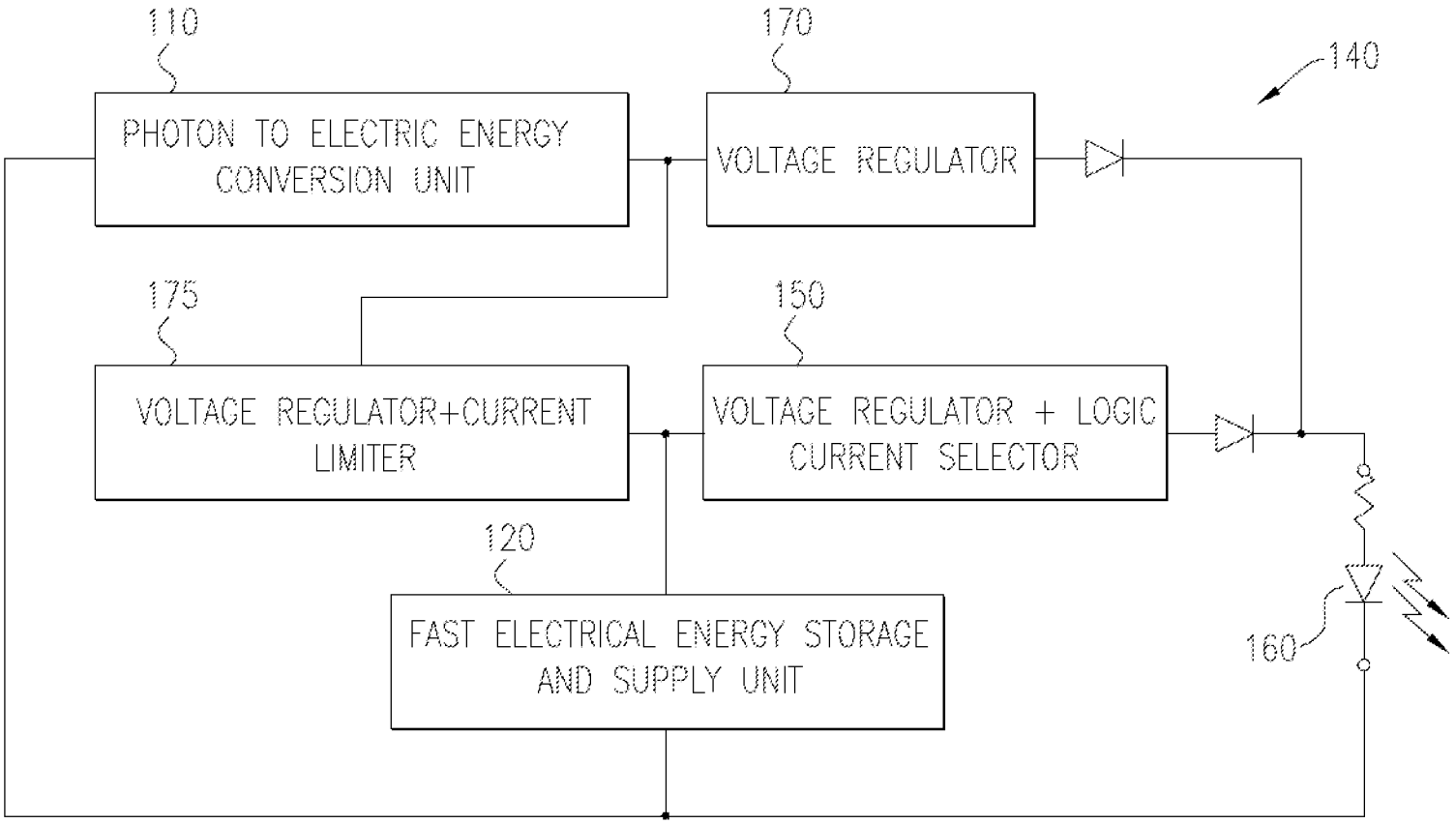
FIG. 3 is a schematic illustration of logic elements of an electronic circuit, according to an embodiment of the disclosure.

FIG. 3 is a schematic illustration of logic elements of electronic circuit 140, according to an embodiment of the disclosure. Optionally, photon energy harvesting device 110 accepts photons from the sun or other light sources and provides electrical power to load 160 to power sight 100. Additionally, photon energy harvesting device 110 provides electrical power to the electrical energy storing element 120 to charge the storing element 120 so that it will serve as a power source when it is dark. In an embodiment of the disclosure, electronic circuit 140 includes a first voltage regulator 170 to control the power provided to load 160. Electronic circuit 140 further includes a second voltage regulator 175 with a current limiter to control storage of the electric power from the photon energy harvesting device 110. Additionally, circuit 140 includes a third voltage regulator 150 with a logic current selector to limit the release rate of current from the electrical energy storing element 120.

In an embodiment of the disclosure, the third voltage regulator 150 with a logic current selector controls the current released from electrical energy storing element 120 to the load 160 responsive to the lighting conditions surrounding sight 100. When the photon energy harvesting device 110 provides a strong current, more current may be provided to load 160 to increase the illumination brightness of the sight 100 (e.g. under daylight). In contrast when less current is provided or no current is provided, load 160 may receive less current and reduce the illumination brightness of sight 100 (e.g. at night). Alternatively, load 160 may receive a constant current in all conditions or current intensity may be user selectable, for example with switch 130.

Figure 4:
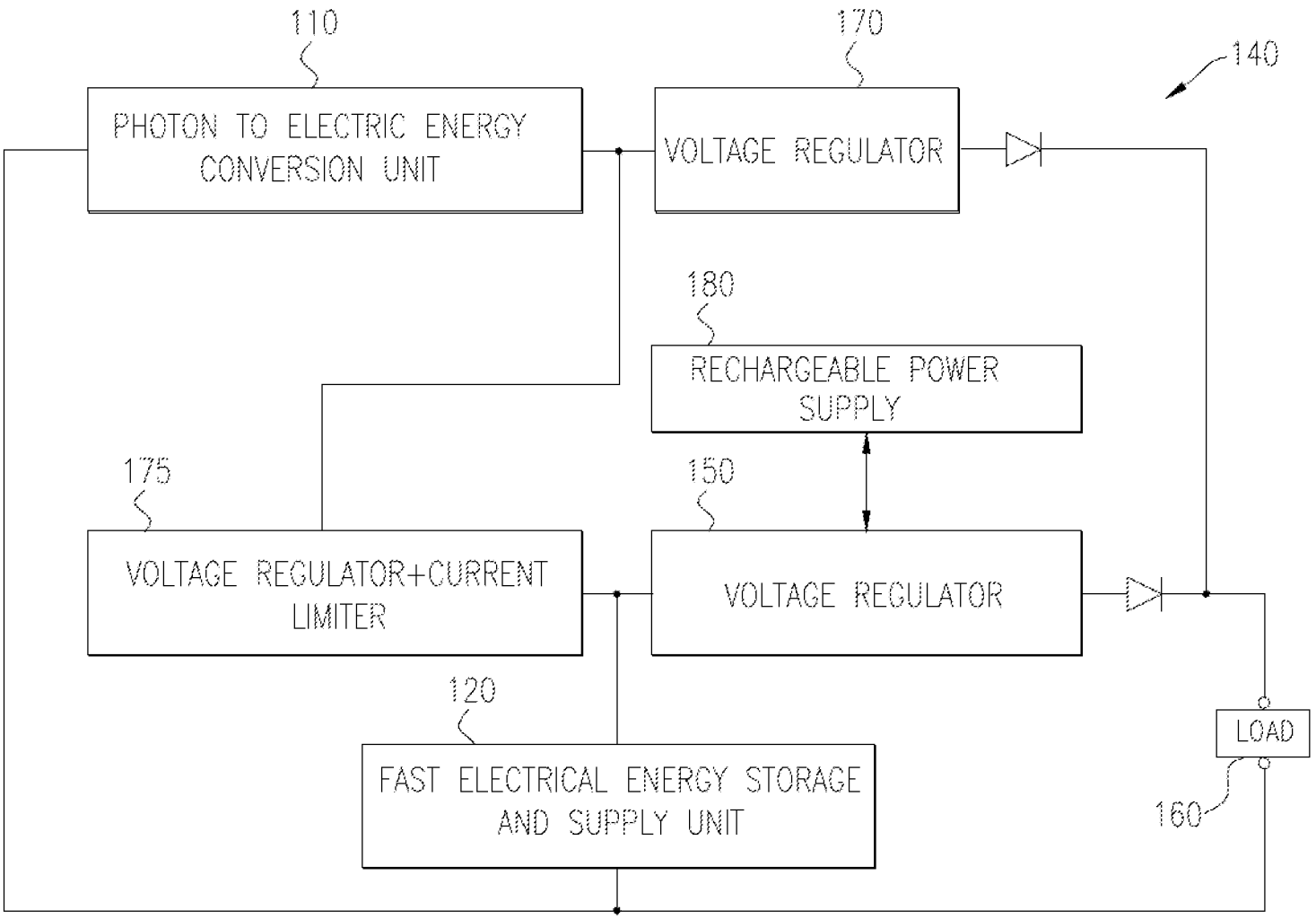
FIG. 4 is a schematic illustration of logic elements of an electronic circuit with a backup power supply, according to an embodiment of the disclosure.

FIG. 4 is a schematic illustration of logic elements of electronic circuit 140 with a backup power supply 180, according to an embodiment of the disclosure. Backup power supply 180 may be a standard rechargeable chemical battery, for example a Lithium-Ion battery or other type of rechargeable battery. In an embodiment of the disclosure, power from electrical energy storing element 120 is provided to backup power supply 180 while powering load 160, for example, a percentage of the power transferred to the load 160 is stored in the backup battery for long-term storage. Optionally, backup power supply 180 is charged even if the load of sight 100 is turned off as long as ambient light is available to charge the electronic circuit 140. In some embodiments of the disclosure, backup power supply 180 receives excess charge only after electrical energy storing element 120 is fully charged or charged to a preselected level.

In an embodiment of the disclosure, load 160 is powered preferentially from electrical energy storing element 120. If electrical energy storing element 120 is depleted or goes below a threshold value then power will be drawn from backup power supply 180.

In some embodiments of the disclosure, load 160 includes at least a single dot LED light. Alternatively, the load may include a set of LED light segments, which provide the user with various indications while using the sight 100.

In some embodiments of the disclosure, the load is a light source that excites a colored light fiber, which provides an illumination dot for the user. In some embodiments of the disclosure, sight 100 may also include a tritium light source, which may provide light in addition to, or instead of an electrically powered illumination dot. Optionally, if the power of the electrical energy storing element 120 is depleted and/or if the power of backup power supply 180 is depleted, the sight 100 illuminates with light from the Tritium.

In an embodiment of the disclosure, photon energy harvesting device 110 may be placed on top of sight 100 and/or on side walls of the sight to enhance photon energy collection.

In an embodiment of the disclosure, the photon energy harvesting device 110 is configured to harvest photons from visible light and non-visible light, for example from infrared light or ultra-violet light. Optionally, the photon energy harvesting device 110 may include a mixture of solar cells each configured to harvest photons from different wavelengths and absorb a greater spectrum of light.

In some embodiments of the disclosure, the solar cells are manufactured from silicon. Alternatively, triple junction GaAs solar cells may be used. Typical GaAs solar cells are generally lighter, thinner, have a higher efficiency and are more flexible than Silicon solar cells.

It should be appreciated that the above described methods and apparatus may be varied in many ways, including omitting or adding steps, changing the order of steps and the type of devices used. It should be appreciated that different features may be combined in different ways. In particular, not all the features shown above in a particular embodiment are necessary in every embodiment of the disclosure. Further combinations of the above features are also considered to be within the scope of some embodiments of the disclosure.

It will be appreciated by persons skilled in the art that the present invention is not limited to what has been particularly shown and described hereinabove. Rather the scope of the present invention is defined only by the claims, which follow.

We claim:

1. A weapon sight, comprising:

a photon energy harvesting device configured to accept photon energy from light surrounding the weapon sight;

an electrical energy storing element configured to store electrical energy from the photon energy harvesting device in the form of an electric field; wherein said electrical energy storing element is a supercapacitor;

a load configured to be powered by the electrical energy storing element;

a voltage regulator configured to limit the release rate of current from the electrical energy storing element to power the load;

wherein the voltage regulator is configured to automatically increase or decrease the current provided to the load responsive to the lighting conditions surrounding the weapon sight; and wherein the weapon sight is powered directly from ambient light by the photon energy harvesting device and/or indirectly by the electrical energy storing element and not by a battery.

2. The weapon sight according to claim 1, wherein said weapon sight is powered only by the electrical energy storing element.

3. The weapon sight according to claim 1, wherein said photon energy collecting device comprises solar cells.

4. The weapon sight according to claim 1, wherein the load includes at least a single dot LED light.

5. The weapon sight according to claim 1, wherein the load illuminates the sight and illumination brightness of the sight is stronger when the light surrounding the weapon sight is stronger.

6. The weapon sight according to claim 1, wherein the current provided to the load is user selectable.

7. A method of powering a weapon sight, comprising:

accepting photon energy from light surrounding the weapon sight with a photon energy harvesting device;

storing electrical energy from the photon energy harvesting device to an electrical energy storing element that is configured to store electrical energy in the form of an electric field; wherein said electrical energy storing element is a supercapacitor;

powering a load with electrical power from the electrical energy storing element;

limiting the release rate of current from the electrical energy storing element with a voltage regulator;

wherein the voltage regulator is configured to automatically increase or decrease the current provided to the load responsive to the lighting conditions surrounding the weapon sight; and wherein the weapon sight is powered directly from ambient light by the photon energy harvesting device and/or indirectly by the electrical energy storing element and not by a battery.

8. The method according to claim 7, wherein said weapon sight is powered only by the electrical energy storing element.

9. The method according to claim 7, wherein said photon energy collecting device is comprises solar cells.

10. The method according to claim 7, wherein the load includes at least a single dot LED light.

11. The method according to claim 7, wherein the load illuminates the sight and illumination brightness of the sight is stronger when the light surrounding the weapon sight is stronger.

12. The method according to claim 7, wherein the current provided to the load is user selectable.

13. The weapon sight according to claim 1, wherein the photon energy harvesting device comprises a mixture of solar cells each configured to harvest photons of different wavelengths.

14. The method according to claim 7, wherein the photon energy harvesting device comprises a mixture of solar cells each configured to harvest photons of different wavelengths.

* * * * *